US007786415B2

(12) United States Patent
Thomas et al.

(10) Patent No.: US 7,786,415 B2
(45) Date of Patent: Aug. 31, 2010

(54) INDUCTION HEATING SYSTEM HAVING MULTIPLE TEMPERATURE INPUT CONTROL

(75) Inventors: Jeffrey R. Thomas, Appleton, WI (US); Randall G. Baxter, Black Creek, WI (US); Paul D. Verhagen, Appleton, WI (US); Edward G. Beistle, Appleton, WI (US)

(73) Assignee: Illinois Tool Works Inc., Glenview, IL (US)

( * ) Notice: Subject to any disclaimer, the term of this patent is extended or adjusted under 35 U.S.C. 154(b) by 777 days.

(21) Appl. No.: 11/145,285

(22) Filed: Jun. 3, 2005

(65) Prior Publication Data

US 2006/0289495 A1 Dec. 28, 2006

(51) Int. Cl.
*H05B 6/42* (2006.01)

(52) U.S. Cl. ..... 219/677; 568/72

(58) Field of Classification Search ..... 219/667, 219/627, 661–663, 677, 494, 510; 266/87, 266/129; 568/72

See application file for complete search history.

(56) References Cited

U.S. PATENT DOCUMENTS

| | | | | | |
|---|---|---|---|---|---|
| 3,506,715 | A * | 4/1970 | Clark | ..... | 568/72 |
| 4,307,276 | A * | 12/1981 | Kurata et al. | ..... | 219/650 |
| 5,373,143 | A * | 12/1994 | Pfaffmann | ..... | 219/637 |
| 6,649,887 | B2 * | 11/2003 | Budinger | ..... | 219/615 |
| 6,713,737 | B1 * | 3/2004 | Verhagen | ..... | 219/667 |
| 2003/0038130 | A1 | 2/2003 | Thomas | | |
| 2006/0006210 | A1 * | 1/2006 | Nonomura et al. | ..... | 228/101 |

FOREIGN PATENT DOCUMENTS

| | | | | |
|---|---|---|---|---|
| EP | 0804050 A2 | 10/1997 | | |
| JP | 4-249883 | * 9/1992 | ..... | 219/667 |
| JP | 5-258849 | * 10/1993 | ..... | 219/667 |
| JP | 2001-349556 | * 12/2001 | | |

* cited by examiner

*Primary Examiner*—Quang T Van
(74) *Attorney, Agent, or Firm*—Fletcher Yoder

(57) ABSTRACT

A system and method for inductively heating a work piece. The induction heating system is coupleable to a plurality of temperature feedback devices operable to provide a signal representative of work piece temperature. The induction heating system is operable to control the output of the induction heating system based on the plurality of signals representative of work piece temperature received from the plurality of temperature feedback devices.

3 Claims, 8 Drawing Sheets

FIG. 3a
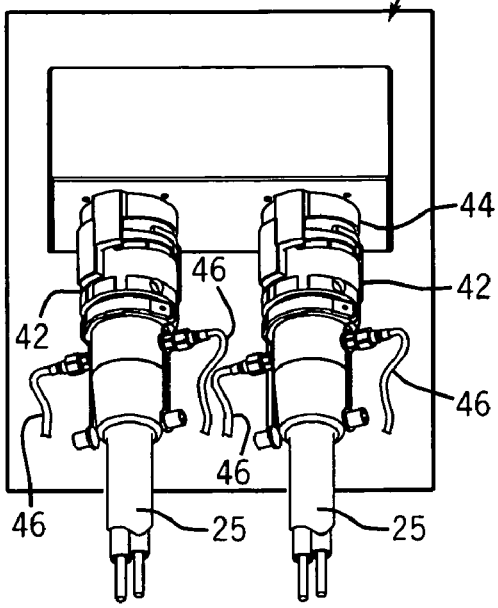
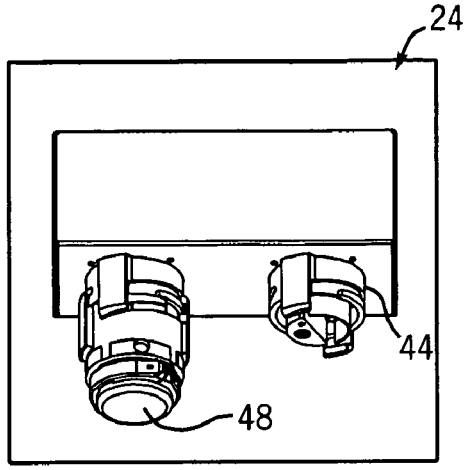
FIG. 3b
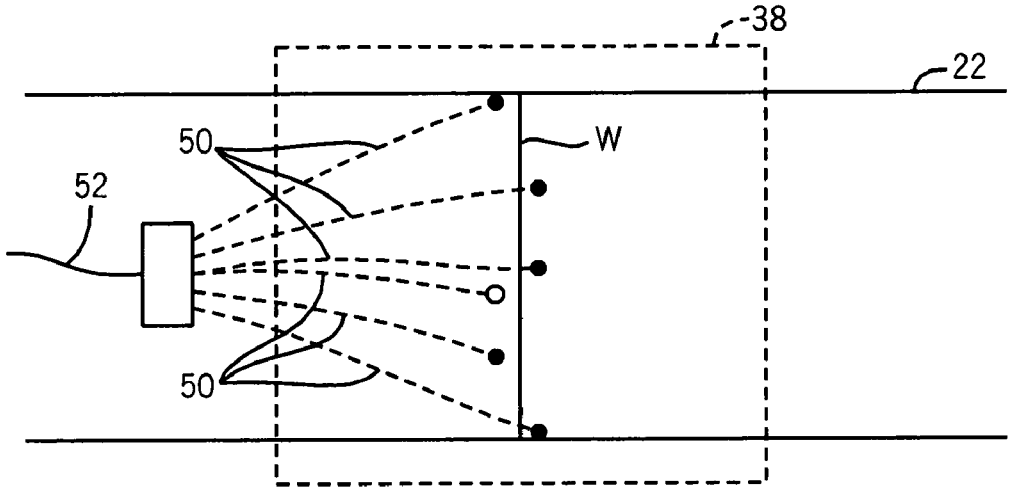
FIG. 4
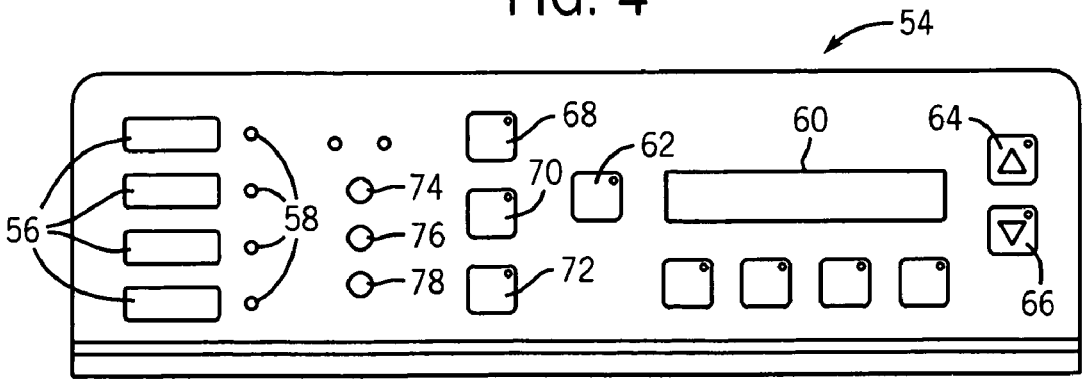
FIG. 5

INDUCTION HEATING SYSTEM HAVING MULTIPLE TEMPERATURE INPUT CONTROL

BACKGROUND OF THE INVENTION

The present invention relates generally to induction heating and, particularly, to a system for inductively heating a work piece based on temperature feedback from a plurality of temperature feedback devices.

Induction heating is a method of heating that utilizes a varying magnetic field to heat a work piece. This varying magnetic field is produced by transmitting an alternating current through an induction heating device. A work piece located inside or in close proximity to the induction heating device is exposed to the varying magnetic field, inducing movement of electrons and causing a flow of eddy currents in the work piece. These eddy currents and resistance to current flow within the work piece cause the temperature of the work piece to rise. A varying magnetic field may be produced by transmitting an alternating current through the coil. Thus, the amount of heat induced in the work piece may be controlled by changing the magnetic field strength as a result of varying the amount of alternating current flowing through the induction heating device.

Certain induction heating systems utilize a temperature feedback device to control the heating of the work piece. A temperature feedback device provides a signal representative of the temperature of the work piece at a single, specific location on the work piece. For example, in some applications, a work piece is heated to a desired temperature, and a temperature feedback device informs the system when this desired temperature has been reached. As another example, it may be desired to heat the work piece at a defined rate of temperature increase. To effectuate such control, the temperature feedback device enables the system to control the amount of power provided to heat the work piece, causing portions of the work piece to increase in temperature at the desired rate.

Uniformity in heating is affected by the arrangement of the induction heating coil, and in some cases, depending on it's arrangement, may cause the induction heating systems to fail to heat the part uniformly. That is, various portions of a given work piece may be at different temperatures with respect to one another. Therefore, the temperature of the work piece where the single temperature feedback device is located may not represent the temperature of the work piece as a whole. As a result, the induction heating system may apply too much power or too little power to heat the work piece as desired. In many applications, such as post-weld stress relief, the entire work piece, or a desired portion of the work piece, must be appropriately heated to achieve the desired changes in the material properties of the work piece. If a portion of the work piece is not heated as desired, the desired changes in the material properties of the work piece may not be achieved. Therefore, a technique is needed to accurately measure the temperature of the work piece, utilizing several temperature feedback devices, and use the temperature measurement information to control the heating and cooling process to assure the process meets the desired heating profile.

SUMMARY OF THE INVENTION

In accordance with certain embodiments, the present technique provides systems and methods for inductively heating a work piece. The exemplary induction heating system is coupleable to a plurality of temperature feedback devices that are each operable to provide a signal representative of work piece temperature at a given location. The induction heating system is operable to control the output of the induction heating system based on the plurality of signals representative of work piece temperature received from the plurality of temperature feedback devices. That is, the exemplary induction heating system analyzes data from the plurality of feedback devices to effectuate more appropriate and accurate heating or cooling of a work piece, and better conformity with a desired heating or cooling profile, for instance.

BRIEF DESCRIPTION OF THE DRAWINGS

The invention will hereafter be described with reference to the accompanying drawings, wherein like reference numerals denote like elements, and:

FIGS. 3*a* and 3*b* are elevation views of a rear portion of the induction heating system of FIG. 1, FIG. 3*a* illustrating the rear portion with cables attached thereto and FIG. 3*b* illustrating the rear portion without cables attached thereto;

FIG. 4 is an elevation view of a work piece and a plurality of temperature feedback devices disposed on the work piece, according to an exemplary embodiment of the present technique;

FIG. 5 is an elevation view of the control panel of the induction heating system of FIG. 1, according to an exemplary embodiment of the present technique;

DETAILED DESCRIPTION OF THE PREFERRED EMBODIMENTS

Figure 1:
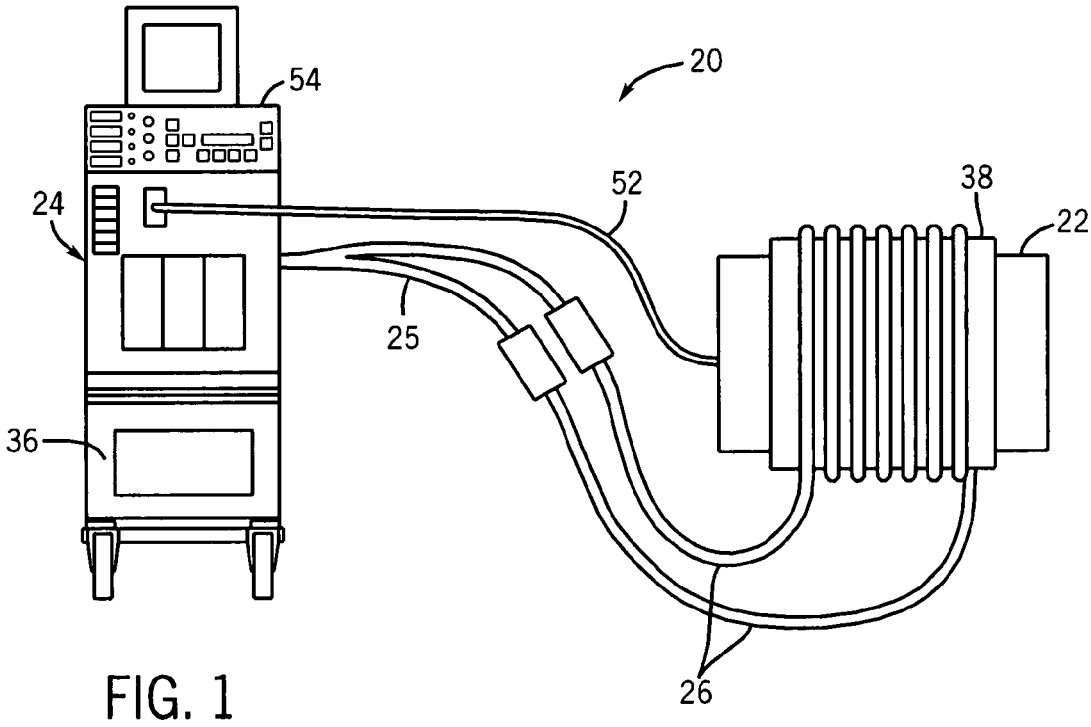
FIG. 1 diagrammatically illustrates an induction heating system, according to an exemplary embodiment of the present technique.

Referring generally to FIG. 1, a system 20 for inductively heating a work piece 22 is illustrated. In FIG. 1, the work piece 22 is a pipe comprising two circular pipe sections welded together and surrounded by a protective thermal blanket 38. However, it is worth noting that the induction heating system 20 is operable to inductively heat a variety of different work pieces. In the illustrated embodiment, the induction heating system 20 comprises an induction heating power source 24, a fluid-cooling unit 36, a fluid-cooled extension cable 25, and a fluid-cooled induction heating cable 26. Alternatively, the induction heating system 20 may comprise an air-cooled induction heating cable or air-cooled heating blanket, for example. Moreover, the induction heating cable 26, whether air-cooled or liquid-cooled, may be coupled to the power source 24 via an appropriate extension cable. The induction heating cable 26 is flexible to enable the induction heating cable 26 to be wrapped around the work piece 22 to form a coil.

Figure 2:
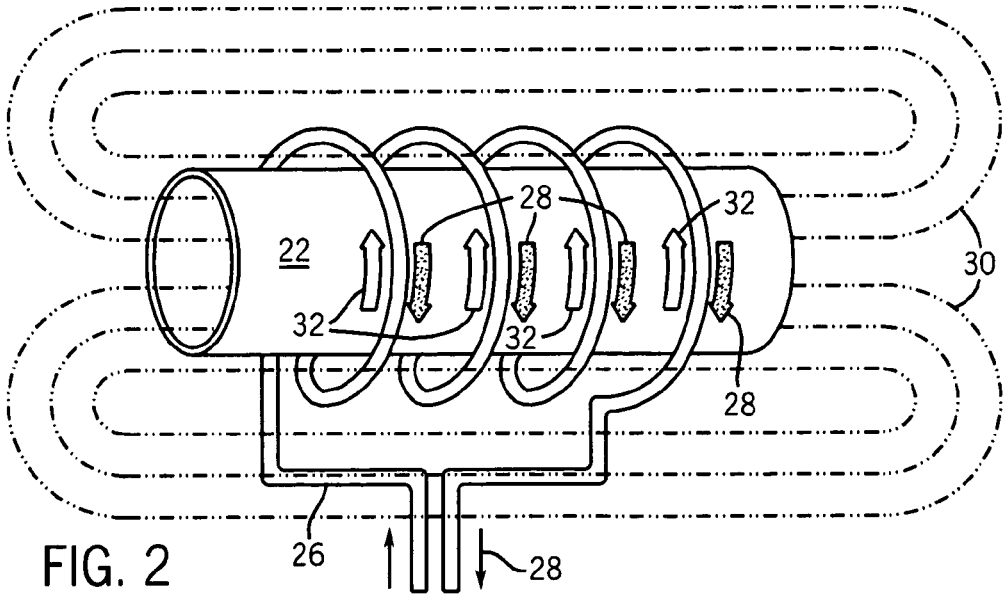
FIG. 2 is a diagram of the process of inducing heat in a work piece using a varying magnetic field, according to an exemplary embodiment of the present technique.

As illustrated in FIG. 2, the induction heating power source 24 is operable to produce an alternating electrical current 28 that is conducted through the induction heating cable 26. The alternating electrical current 28 flowing through the fluid-cooled induction heating cable 26 produces a varying magnetic field 30 that induces a flow of eddy currents 32 in the work piece 22 and that, in turn, heats the work piece 22. Accordingly, controlling the level of alternating electrical current from the induction heating power source 24 changes the strength of the magnetic field, thereby controlling the amount of heat generated in the work piece 22.

Referring generally to FIG. 3*a*, the fluid-cooled induction heating extension cables 25 have connectors 42 that engage with corresponding connectors 44 on the induction heating power source 24. The connectors conduct electricity from the power source 24 to the fluid-cooled induction heating extension cable 25. External to the connectors 42, cooling fluid from the fluid cooling unit 36 is provided to the fluid-cooled induction heating extension cable 25 via hoses 46. The connectors 44 also enable an air-cooled induction heating cable to be coupled to the induction heating power source 24. In this embodiment, as shown in FIG. 3*b*, protective covers 48 may be placed over connector 44 when not in use.

Referring generally to FIGS. 1 and 4, the induction heating system 20 is operable to receive temperature feedback from a plurality of temperature feedback devices 50, such as thermocouples, resistance temperature detectors (RTD's), or infrared sensors. These temperature feedback devices facilitate heating of the work piece 22 to a desired temperature and/or at a desired rate of temperature change. The exemplary thermocouples 50 are secured to the work piece 22 by spot welding and are coupled to the induction heating power source 24 by an extension cable 52.

In the illustrated application, the work piece 22 has a weld joint "W" extending circumferentially around the work piece 22. As will be discussed in more detail below, the induction heating system 20 is operable to heat the work piece 22 automatically to perform pre-heat or post-weld stress relief of the weld joint W in accordance with profile programmed into the induction heating power source 24. However, as the work piece 22 is heated, the temperature of the work piece 22 may not be uniform over the entire portion of the work piece 22 to be heated. For example, the bottom of the weld joint W may initially be at a higher temperature than the top of the weld joint W. At a later point in time, the temperature at the top of the weld joint W may be greater than the temperature at the bottom of the weld joint W. As will be discussed below, the exemplary induction heating power source 24 is designed to accurately measure and control the temperature of the workpiece from a plurality of temperature measuring devices located on the work piece to facilitate uniform heating of the work piece 22 by the induction heating cable 26 and to account for such variances in temperature.

Referring generally to FIG. 5, the illustrated induction heating power source 24 has a control panel 54 that enables a user to program the induction heating power source 24 to perform a variety of heating operations. For example, the control panel 54 may be used to program the induction heating power source 24 to heat the work piece 22 at a desired heat-up rate. In addition, the induction heating power source 24 may be programmed to maintain the work piece 22 at an elevated temperature for a desired period of time. The induction heating power source 24 may also be programmed to reduce the work piece temperature from an elevated temperature at a desired cool-down rate. It is worth noting that a number of operating programs are envisaged, and the foregoing techniques are merely examples.

The exemplary control panel 54 facilitates controlled operations of the induction heating power source 24 and the magnetic field created by the induction heating device. This control panel 54 has four temperature displays 56, one for each of the four thermocouples 50 operable to control operation of the induction heating power source 24. With the control panel 54, an operator may monitor the temperature displays 56 for differences in the temperatures of various portions of the work piece 22. The exemplary control panel 54 also has four control lights 58, one for each of the thermocouples 50 used to control temperature, to indicate which of the four control thermocouples 50 is controlling the operation of the system 20 at that point in time in the heating program. In addition, the illustrated control panel 54 has a main display 60 that facilitates programming of the induction heating power source 24 and monitoring system parameters, such as the output power, output voltage current, and output frequency. Additionally, the display is capable of providing program status information as well as diagnostic information should a problem arise. In this embodiment, the control panel 54 has a cursor button 62 that may be used in cooperation with the main display 60 to program the induction heating power source 24. For example, the cursor button 62 may enable the user to select a desired heating function from a plurality of available heating functions, such as a heating the work piece 22 at a desired heat-up rate, maintaining the work piece at a desired temperature for a desired period of time, or lowering the temperature of the work piece 22 from an elevated temperature at a desired cool-down rate. In addition, the illustrated control panel 54 has an up arrow button 64 and a down arrow button 66 to enable a user to input data, such as a desired heat-up rate, a desired temperature, a desired time, and a desired cool-down rate.

The illustrated control panel 54 also has a run button 68, a hold button 70, and a stop button 72 that may be used to control the operation of the induction heating system 20. The run button 68 enables a user to initiate operation of the induction heating system 20. The hold button 70 enables a user to pause operation of the induction heating system 20 temporarily and maintain work piece temperature. For example, if the operator observes differences in work piece temperatures on the temperature displays 56, the operator may press the hold button 70 to pause heating operations, allowing the operator to take positive actions to correct the temperature difference, if necessary. The operator may adjust the position of the cable 26 as it is coiled on the work piece 22 to adjust the work piece 22 heating and, thereby, reduce any differences in temperatures, for instance. Operation restart of the heating system 20 in accordance with the programming instructions is achieved by pressing the run button. The operator may adjust the position of the cable 26 as it is coiled on the work piece 22 to adjust the work piece heating and, thereby, reduce any differences in temperatures, for instance. The stop button 72, however, halts operation of the system 20 completely. The control panel 54 may also have a light 74 to provide an indication to a user that a fault condition exists. Another light 76 may be provided to indicate to a user when an operating limit, such as output voltage or current, has been reached.

Finally, a light 78 may be provided to indicate when power is being applied to the induction heating cables 26.

Figure 6:
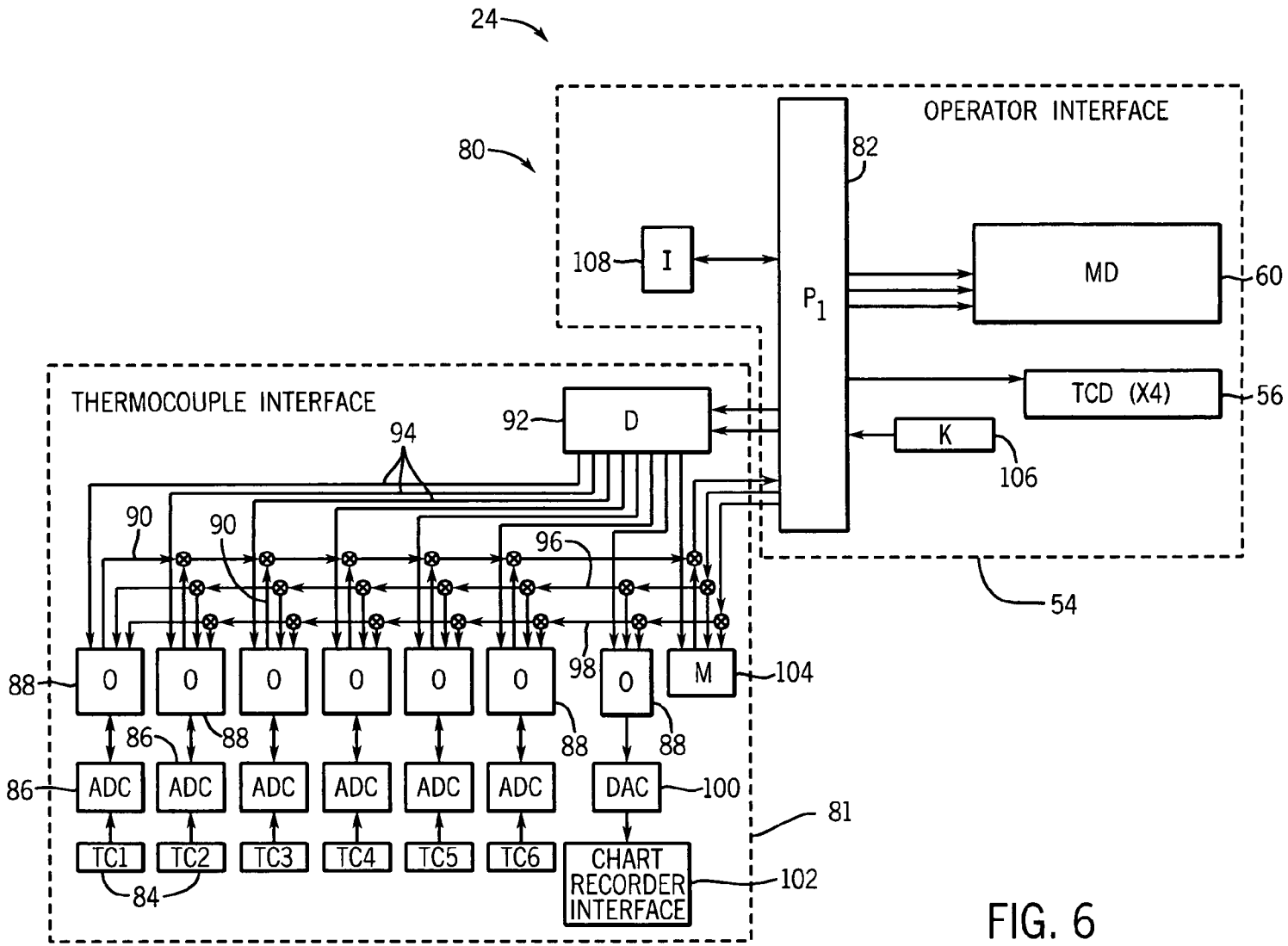
FIG. 6 is a schematic diagram of a temperature controller, according to an exemplary embodiment of the present technique.

Referring generally to FIG. 6, the induction heating power source 24 has a temperature control circuit 80 that includes a thermocouple interface board 81 and the control panel 54 for operator interface. The temperature control circuit 80 utilizes a processor 82, located on the operator interface 54, to direct operation of the induction heating system 20 in response to programming instructions received from the control panel 54 and temperature data received from the thermocouples 50 connected to the thermocouple interface board 81. The illustrated induction heating system 20 has six thermocouple inputs 84 to enable each of the six thermocouples 50 to be connected to the induction heating power source 24. Each of the thermocouple inputs 84 is coupled to an analog-to-digital converter (ADC) 86 that converts the analog temperature data from the thermocouples 50 into a digital temperature signal. Each ADC 86 is coupled to an optoisolator 88. Each optoisolator 88 couples the digital temperature signal from an ADC 86 to the processor 82 while maintaining electrical isolation of the processor 82 from each ADC 86. It is worth noting that multi-channel optoislators are envisaged as well.

In this embodiment, the processor 82 receives digital temperature data from each ADC 86 sequentially. A number of circuit paths are provided to enable the processor 82 to communicate with each ADC 86 and a decoder 92. A first signal bus 90 is provided to couple the digital temperature data from each of ADC 86 to the processor 82. The decoder 92 is provided to control each ADC 86 to transmit the digital temperature data sequentially to the processor 82. A second signal bus 94 is provided to couple the decoder 92 to each ADC 86. A third signal bus 96 is provided to enable the processor 82 to communicate to each ADC 86. Each ADC 86 transmits its temperature data to the processor 82 when queued by the decoder 92 and the processor 82. A fourth signal bus 98 is provided to transmit calibration data to each ADC 86. A digital-to-analog converter (DAC) 100 is provided to couple the temperature data to a chart recorder via a chart recorder interface 102. In addition, a memory device 104 is provided to store calibration data.

The processor 82 is operable to receive programming instructions from the various programming buttons 106 disposed on the control panel 54. However, other methods of programming the processor 82 may be used. The programming buttons 106 comprise the cursor button 62, the up arrow button 64, the down arrow button 66, the run button 68, the hold button, 70, the stop button 72, etc. The processor 82 may also provide signals to the temperature displays 56 and the main display 60. The processor 82 produces an output signal that is coupled to a power source controller interface 108.

Figure 7:
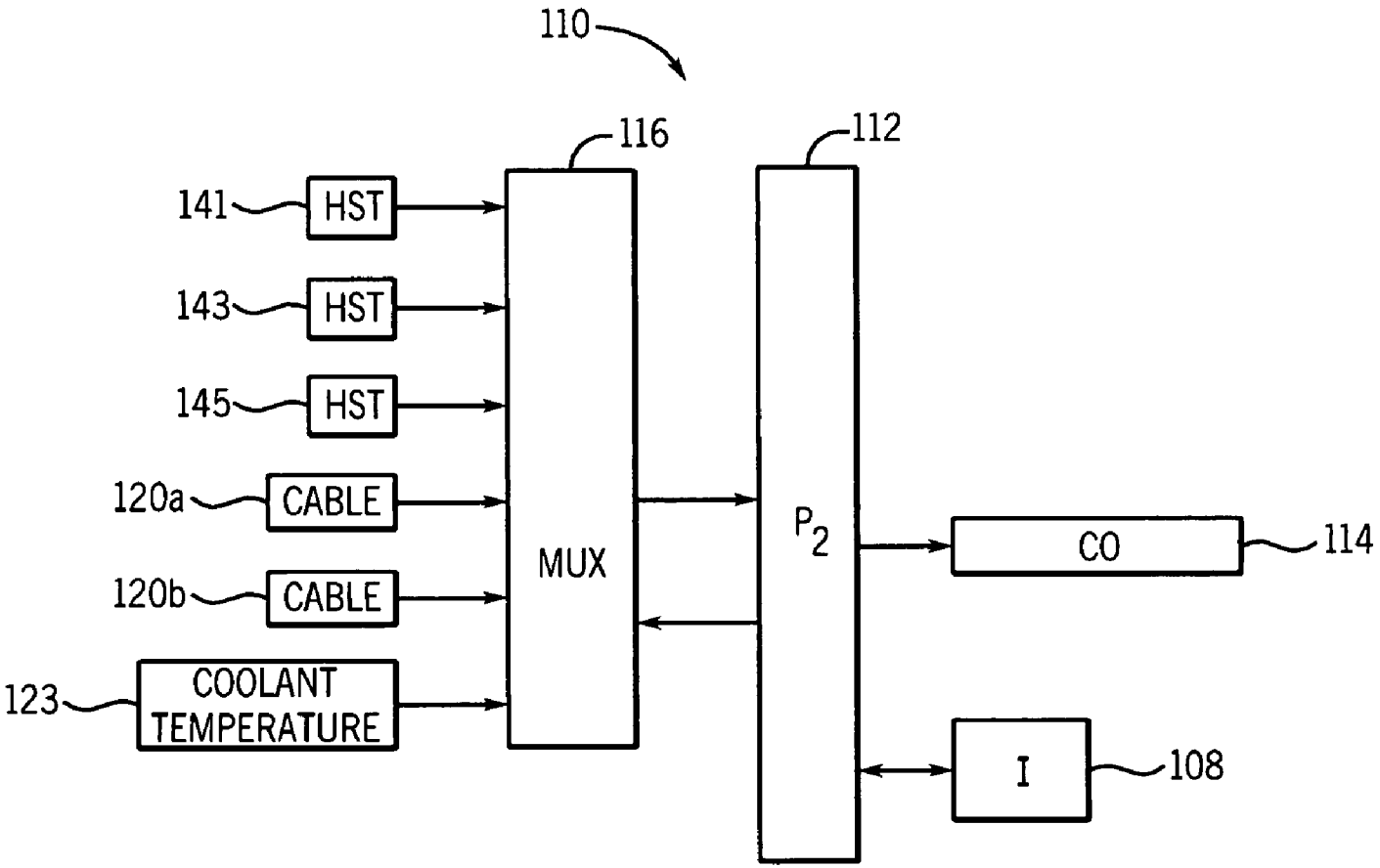
FIG. 7 is a schematic diagram of a power source controller, according to an exemplary embodiment of the present technique.

Referring generally to FIG. 7, the power source controller interface 108 couples the control signal from the temperature controller circuit 80 to an induction heating power source controller 110. The induction heating power source controller 110 has a processor 112 that provides a command signal 114 that controls the output of the induction heating power unit based on the control signal received from the processor 82 in the temperature controller circuit 80. The processor 112 also receives inputs from a multiplexer 116. As will be discussed in more detail below, the multiplexer 116 receives a thermistor input 123 from the fluid cooling unit 36 and thermistor inputs 141, 143, and 145 from a plurality of thermistors 142, 144, and 148 respectively, disposed within the induction heating power source 24. Additionally, the multiplexer 116 receives induction heating extension cable identifiers 120*a* and 120*b* from the induction heating power source connector 44 illustrated in FIGS. 3*a* and 3*b*. In addition to control based on inputs from the temperature control circuit 80, the power source controller 110 is operable to control power from the induction heating power source 24 based on the thermocouple inputs 123, the extension cable identifiers 120*a* and 120*b*, and the heat sink temperature inputs 141, 143, and 145.

Figure 8:
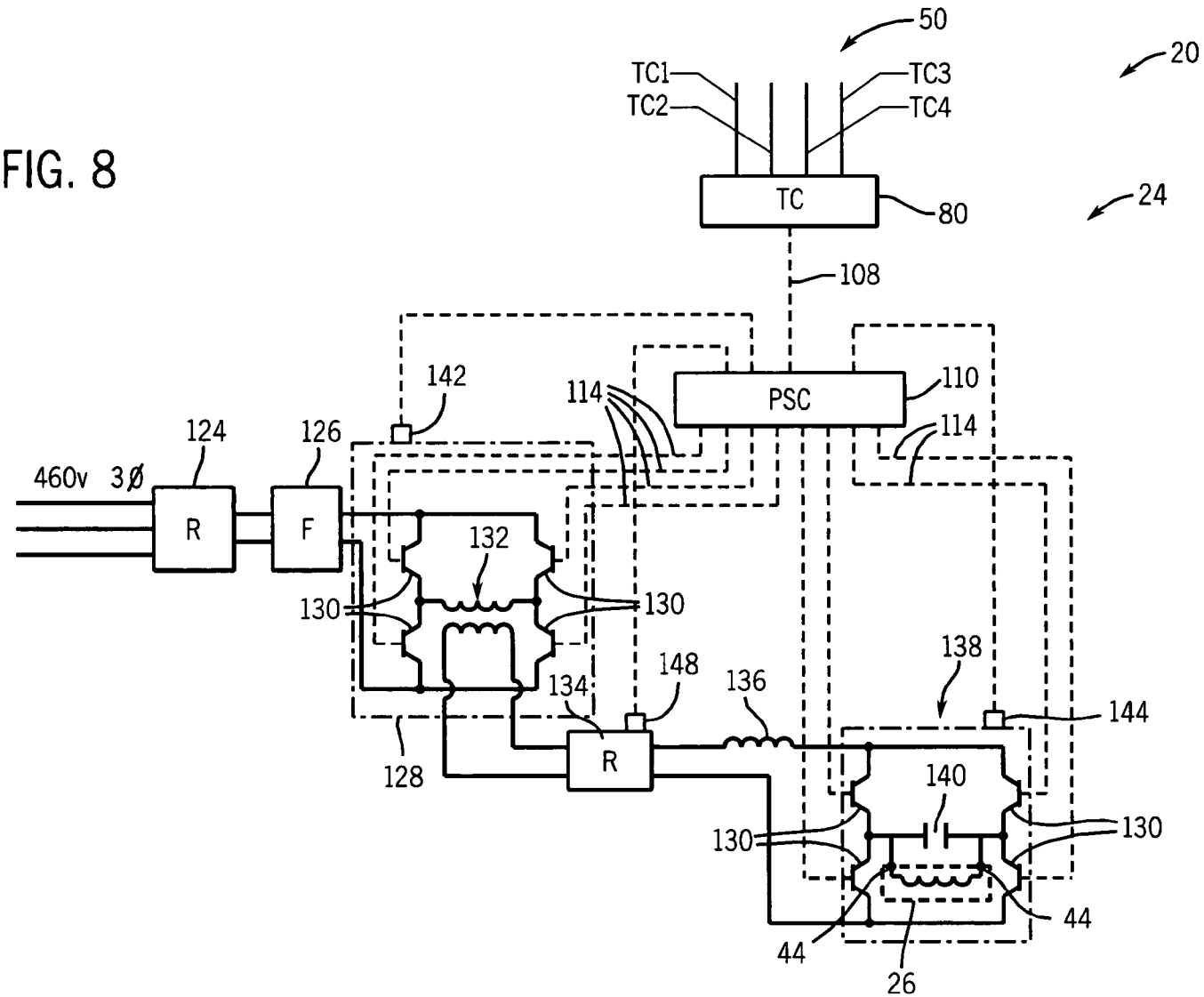
FIG. 8 is a schematic diagram of the induction heating system, according to an exemplary embodiment of the present technique.

Referring generally to FIG. 8, an electrical schematic of the induction heating system 20 is illustrated. The temperature controller 80 receives the temperature feedback from the plurality of temperature feedback devices 50. The temperature controller 80 compares the actual temperature of the work piece 22, represented by the temperature feedback, to a desired temperature based on programming instructions stored in the temperature controller 80. The temperature controller 80 provides a signal 108 to the power source controller 24 that is representative of a desired output of the induction heating power source 24 to make the actual temperature of the work piece 22 equal to the desired temperature. The power source controller 110 controls the operation of the induction heating power source 24 to provide the desired output. As will be discussed in more detail below, the power source controller 110 controls the output of the induction heating power source 110 by controlling the opening and closing of electronic switches in a pair of inverter circuits. By selectively increasing or decreasing the frequency that the electronic switches 130 are opened and closed, the output of the induction heating power source 24 may be increased or decreased as desired.

In the illustrated embodiment, three-phase AC input power is coupled to the induction heating power source 24. A rectifier 124 is used to convert the AC power into DC power. A filter 126 is used to condition the rectified DC power signals. A first inverter circuit 128 is used to invert the DC power into desired AC output power. In the illustrated embodiment, the first inverter circuit 128 comprises a plurality of electronic switches 130, such as IGBTs. The electronic switches 130 are opened and closed by command signals 114 from the power source controller 110. The power source controller 110 controls the operation of the electronic switches 130 to provide the desired output of the induction heating power source 24. A step-down transformer 132 is used to couple the AC output from the first inverter circuit 128 to a second rectifier circuit 134, where the AC is converted again to DC. An inductor 136 is used to smooth the rectified DC output from the second rectifier 134. The output of the second rectifier 134 is coupled to a second inverter circuit 138. The second inverter circuit 138 converts the DC output into high-frequency AC signals. The electronic switches 130 of the second inverter circuit 138 also are opened and closed by command signals 114 from the power source controller 110. The power source controller 110 controls the operation of the electronic switches 130 to provide the desired output of the induction heating power source. A tank capacitor 140 is coupled in parallel with the output connectors 44. As illustrated, the fluid-cooled induction heating cable 26 is connected to connectors 44. However, an air-cooled device may be coupled to connectors 44.

The coiled fluid-cooled induction heating cable 26 is represented on the schematic as an inductor. The inductance of the induction heating cable 26 and the tank capacitor 140 form a resonant tank circuit. The inductance and capacitance of the resonant tank circuit establishes the frequency of the AC current flowing through the fluid-cooled induction heating cable 26. The inductance of the fluid-cooled induction heating cable 26 is influenced by the number of turns of the heating cable 26 around the work piece 22. As discussed above, the current flowing through the fluid-cooled induction heating cable 26 produces the magnetic field that induces eddy current flow, and thus heat in the work piece 22.

A large amount of electrical current may flow through the various components of the induction heating power source 24 and the induction heating cable 26. This current produces heat within the power source 24 that may damage the components. Solid-state components, such as the IGBTs 130 and the rectifiers, are particularly susceptible to heat damage. In the illustrated embodiment, the power source 24 is adapted to control output power to prevent heat damage to certain components. One or more temperature feedback devices, such as thermistors, are disposed within the induction heating power source 24 to provide temperature signals to the power source controller 110. A thermistor 142 is disposed adjacent to the first inverter 128 to provide a signal representative of the temperature of the first inverter 128 to the power source controller 110. Another thermistor 144 is disposed adjacent to the second inverter 138 to provide a signal representative of the temperature of the second inverter 138 to the power source controller 110. Yet another thermistor 148 is provided to provide a signal representative of the temperature of the rectifier 134 to the power source controller 110.

In addition to the signal 108 from the temperature controller 80 that is representative of a desired output of the induction heating power source 24, the power source controller 110 also receives temperature signals from the first thermistor 142, the second thermistor 144, the third thermistor 148, and a coolant temperature input 123 from the fluid cooling unit (illustrated in FIG. 7). The power source controller may be programmed with a variety of control schemes to control the output of the induction heating power source 24 based on the temperature signals from the induction heating system components. For example, the power source controller 110 may be programmed to limit the signal 108 from the temperature controller to direct the induction heating system not to produce additional power when a specified induction heating system component temperature is reached. Alternatively or in addition to the previous example, the power source controller 110 may be programmed to reduce the signal 108 from the temperature controller to direct the induction heating system to produce less power when a specified induction heating system component temperature is reached. The power source controller 110 may even be programmed to stop operation of the induction heating power source 24 if a specified component temperature is reached or exceeded. Limiting or reducing the desired output of the induction heating power source 24 reduces the amount of heat produced within the system 20. Thereby, protecting induction heating system components from heat damage. The foregoing are merely examples of control schemes, and a host of various control schemes are envisaged, although not discussed for clarity. Indeed, the system may be responsive to any combination or permutation of inputs from the signal producing devices, such as thermistors or the thermocouples, for instance, located throughout the system.

Figure 9:
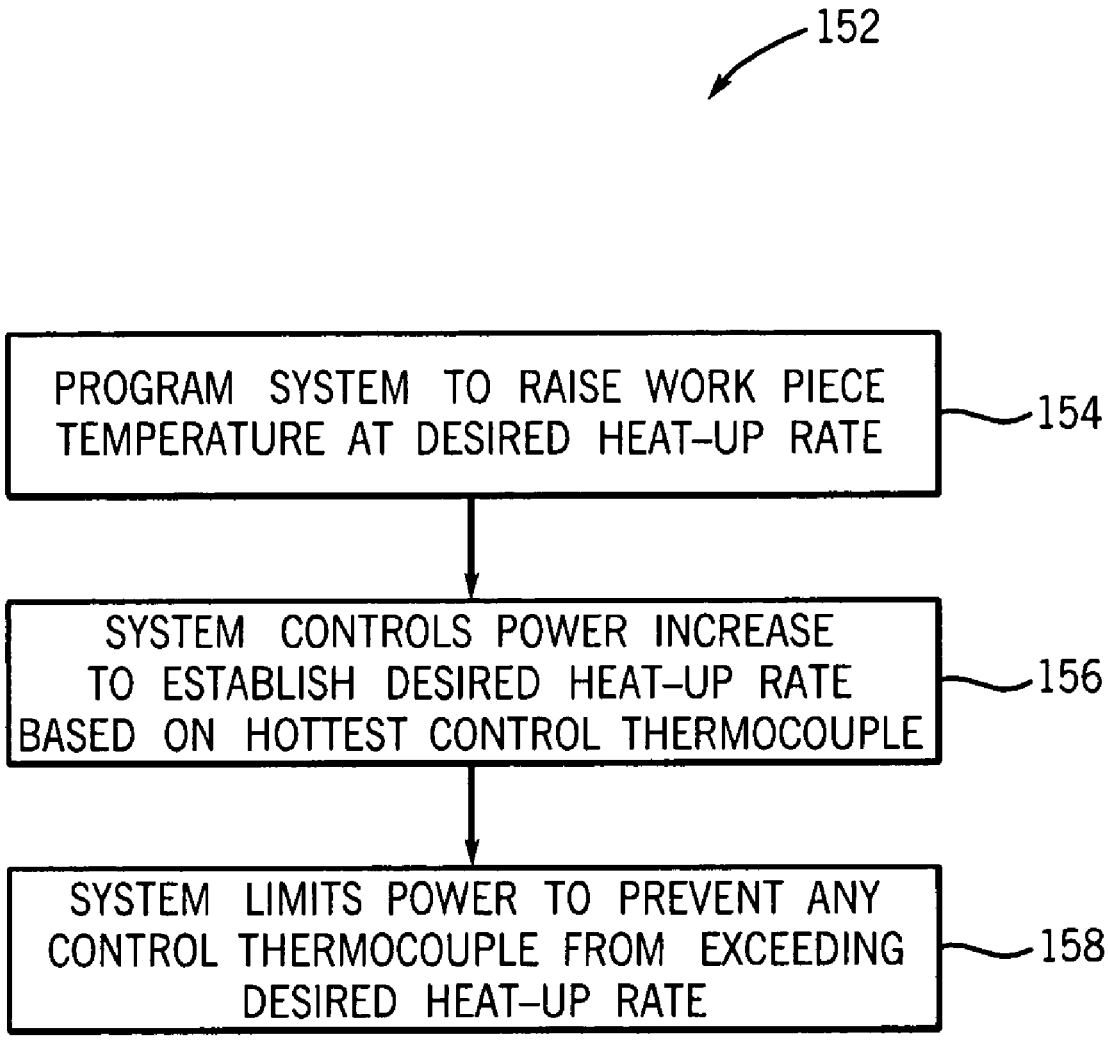
FIG. 9 is a block diagram of a process of using an induction heating system to raise the temperature of a work piece at a desired rate, according to an exemplary embodiment of the present technique.
Figure 10:
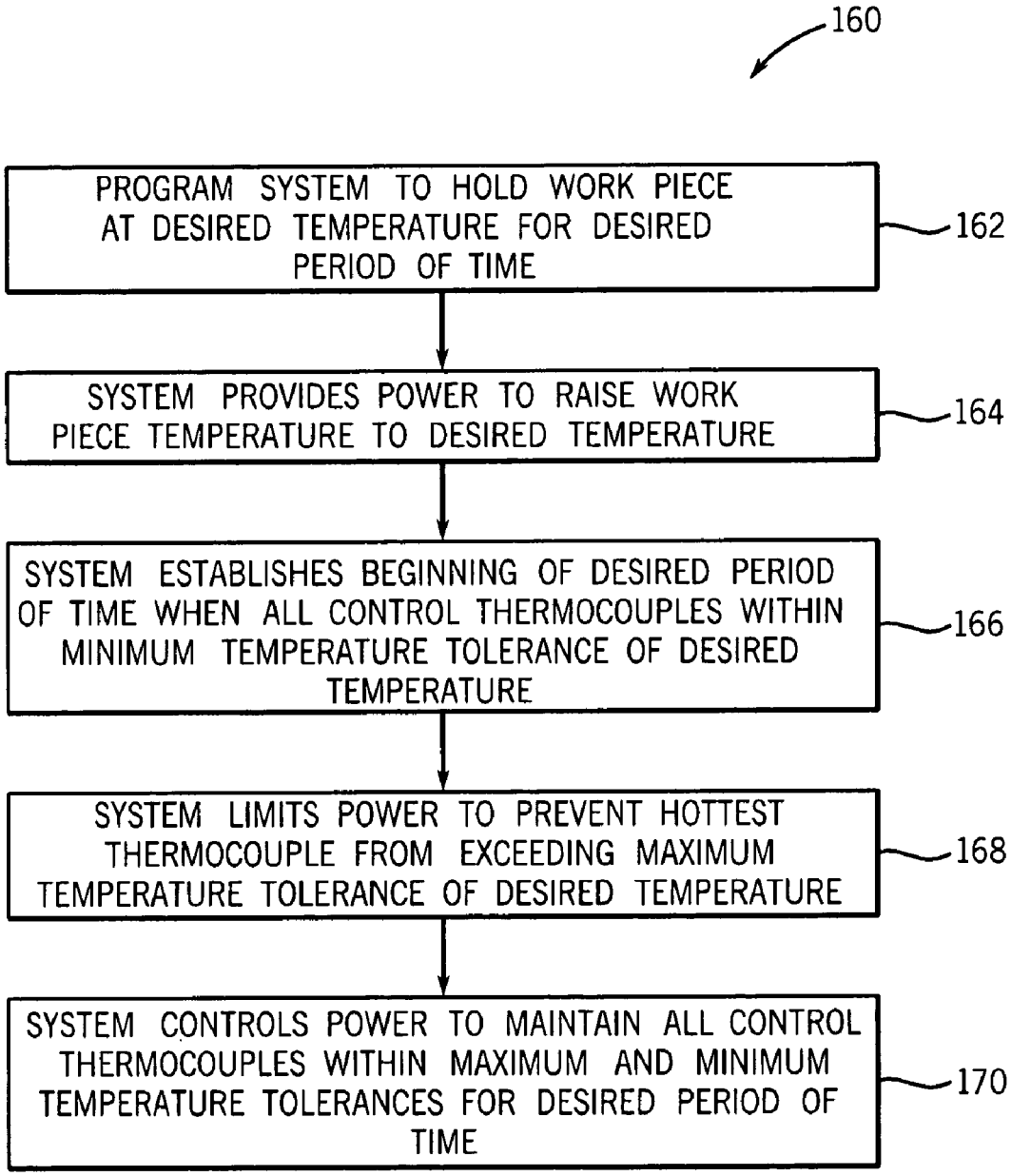
FIG. 10 is a block diagram of a process of using an induction heating system to maintain a heat a work piece at a desired temperature for a desired period of time, according to an exemplary embodiment of the present technique.
Figure 11:
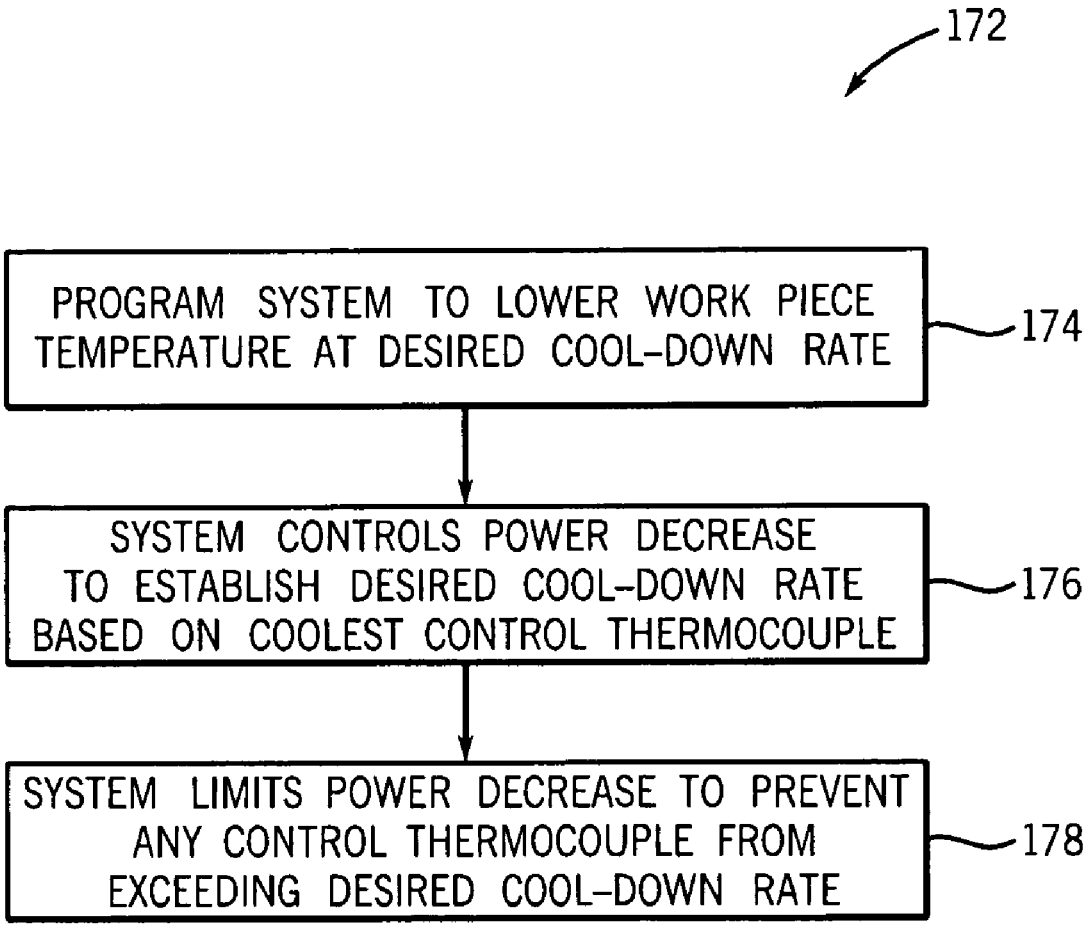
FIG. 11 is a block diagram of a process of using an induction heating system to lower the temperature of a work piece from an elevated temperature at a desired rate, according to an exemplary embodiment of the present technique.

Referring generally to FIGS. 9-11, the induction heating power source 24 is pre-programmed to control power based on the plurality of temperature feedback signals received from the plurality of temperature feedback devices (thermocouples) 50. The quantity of thermocouples (minimum of one and maximum of four) used to control the heating and cooling process is selected during the set-up and programming procedure of the temperature control circuit 80. For example, a block diagram of an exemplary method for heating the work piece 22 at a desired rate based on temperature feedback from a plurality of thermocouples is illustrated in FIG. 9 and represented generally by reference numeral 152. The induction heating power source 24 may be programmed to raise the work piece temperature at a desired heat-up rate, as represented by block 154. The system 20 may be designed to maintain the desired heat-up rate until a desired work piece temperature is obtained.

In the illustrated method, the output power of the induction heating power source 24 is controlled to achieve the desired heat-up rate based on the thermocouples 50 selected for control and more specifically, based on the greatest work piece temperature indicated by highest temperature feedback signal from thermocouple 50, as represented by block 156. For example, if one of the control thermocouples 50 indicates that the work piece temperature is 100° F. and another control thermocouple indicates a work piece temperature of 105° F., the processor 82 will control the output of the induction heating power source 24 based on the 105° F. temperature, rather than the 100° F. temperature. Thus, the signal representative of the 105° F. temperature is the dominant controlling signal. Should the greatest work piece temperature transition to a temperature feedback signal from a different control thermocouple 50, the process 82 will automatically switch to control the output of the induction heating power source based on the new dominating temperature feedback signal.

In addition, in this embodiment, it is envisaged that the system 20 can establish the heat-up rate for each of the control thermocouples 50 and limit the output power to prevent any heat-up rate from any of the control thermocouples 50 from exceeding the desired heat-up rate, as represented by block 158. Thus, if a portion of the work piece was initially at a lower temperature than the hottest portion of the work piece 22 but its temperature began to increase at a faster rate than the desired heat-up rate, the processor 82 acts to limit power from the system, preventing the lower temperature portion of the work piece 22 from exceeding the desired heat-up rate.

In addition, a block diagram of an exemplary method for maintaining the work piece 22 at a desired temperature for a desired period of time based on temperature feedback from a plurality of temperature feedback devices (thermocouples) 50 is illustrated in FIG. 10 and represented generally by reference numeral 160. The induction heating power source 24 can be programmed to provide output power to hold the work piece 22 at a desired temperature for a desired period of time, as represented by block 162. The induction heating power source 24 provides power to the induction heating cable 26 to slowly raise the work piece temperature until all control thermocouples are within the specified temperature tolerance range (programmed during set-up), as represented by block 164.

In the illustrated embodiment, the induction heating power source 24 marks the beginning of the desired period of time only when all of the control thermocouples are indicating work piece temperatures that are within a tolerance band of the desired temperature, as represented by block 166. Thus, during a heating operation to raise the work piece to the desired temperature, the processor 82 does not begin timing the desired period of time as soon as the greatest work piece temperature indicated by the thermocouples 50 reaches the desired temperature. Rather, the processor 82 only begins timing the desired period of time when all of the other work piece temperatures from the other control thermocouples are within the minimum temperature of the tolerance band around the desired temperature. In addition, the induction heating power source 24 limits output parameters to prevent the greatest work piece temperature from exceeding the maximum temperature of the tolerance band around the desired temperature, as represented by block 168. In this embodiment, the induction heating power source 24 controls power to maintain all of the work piece temperatures within the tolerance band for the desired period of time, as represented by block 170. The induction heating power source 24 may be adapted to provide an alarm, fault, or limit indication if one of the work piece temperatures is outside of the tolerance band. The tolerance band may be programmable to enable a user to establish the band, or it may be fixed.

Finally, a block diagram of an exemplary method for cooling the work piece 22 from an elevated temperature to a lower temperature at a desired rate based on temperature feedback from a plurality of temperature feedback devices (thermocouples) 50 is illustrated in FIG. 11 and represented generally by reference numeral 172. The induction heating power source 24 may be programmed to lower the work piece temperature at a desired cool-down rate, as represented by block 174. The desired temperature to which it is desired to lower the work piece temperature may also be programmed into the system. In the illustrated method, the induction heating power source 24 controls the power provided by the induction heating power source 24 to achieve the desired cool-down rate based on the lowest temperature indicated by the thermocouples 50 selected for control, as represented by block 176.

It is also envisaged that the exemplary induction heating power source 24 can also establish the cool-down rate for each of the control thermocouples 50 and limit the output power decrease to prevent any of the cool-down rates from any of the control thermocouples 50 from exceeding the desired cool-down rate, as represented by block 178. Thus, if a portion of the work piece was initially at a higher temperature than the coolest portion of the work piece 22 but its temperature began to decrease at a faster rate than the desired cool-down rate, the processor 82 would control output power from the power source 24 to prevent the higher temperature portion of the work piece 22 from exceeding the desired cool-down rate.

The techniques described above provide a system 20 and a method for inductively heating a work piece 22. In addition, these techniques facilitate heating the work piece uniformly by enabling a plurality of temperature feedback devices to control the operation of the system, thereby preventing portions of the work piece from exceeding temperature limits, heat-up rate limits, or cool-down rate limits, for instance.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An induction heating system, comprising:

An induction heating power source;

a controller configured to control output of the induction heating power source based on a plurality of signals representative of work piece temperatures at a generally common time of induction heating at a portion of a work piece, wherein the controller is operable to select an outlier signal from the plurality of signals representative of work piece temperatures to control the output of the induction heating power source based on a programmed control scheme, wherein the controller comprises a processor operable to receive programming instructions and the plurality of signals representative of work piece temperature from each of a respective one of a plurality of temperature feedback devices, wherein the processor is configured to select one of the plurality of temperature feedback devices to control the induction heating power source based on the signal from the selected temperature feedback device and the programming instructions; and an interface adapted to enable the plurality of temperature feedback devices to be communicatively coupled to the processor, wherein the interface comprises a plurality of analog-to-digital converters configured to convert each of the signals representative of work piece temperatures to a digital signal representative of work piece temperature.

2. An induction heating system, comprising:

An induction heating power source;

a controller configured to control output of the induction heating power source based on a plurality of signals representative of work piece temperatures at a generally common time of induction heating at a portion of a work piece, wherein the controller is operable to select an outlier signal from the plurality of signals representative of work piece temperatures to control the output of the induction heating power source based on a programmed control scheme, wherein the controller comprises a processor operable to receive programming instructions and the plurality of signals representative of work piece temperature from each of a respective one of a plurality of temperature feedback devices, wherein the processor is configured to select one of the plurality of temperature feedback devices to control the induction heating power source based on the signal from the selected temperature feedback device and the programming instructions; and a selector operable to sequentially couple each of the digital signals representative of work piece temperatures to the processor.

3. An induction heating system, comprising:

An induction heating power source;

a controller configured to control output of the induction heating power source based on a plurality of signals representative of work piece temperatures at a generally common time of induction heating at a portion of a work piece, wherein the controller is operable to select an outlier signal from the plurality of signals representative of work piece temperatures to control the output of the induction heating power source based on a programmed control scheme, wherein the controller comprises a processor operable to receive programming instructions and the plurality of signals representative of work piece temperature from each of a respective one of a plurality of temperature feedback devices, wherein the processor is configured to select one of the plurality of temperature feedback devices to control the induction heating power source based on the signal from the selected temperature feedback device and the programming instructions; and a controller is operable to direct the induction heating power source to heat the portion of the work piece at a desired temperature for a desired period of time, and the processor is pre-programmed to measure the desired period of time from when all of the work piece temperatures are within a predesignated range.

* * * * *